United States Patent [19]

Mintzer

[11] Patent Number: 4,893,222

[45] Date of Patent: Jan. 9, 1990

[54] ILLUMINATION DEVICE FOR A HAND-HELD REMOTE CONTROL UNIT

[76] Inventor: Joseph H. Mintzer, 46 Ridge Rd., Hartsdale, N.Y. 10530

[21] Appl. No.: 179,744

[22] Filed: Apr. 11, 1988

[51] Int. Cl.[4] ..... F21V 33/00

[52] U.S. Cl. ..... 362/109; 362/23; 362/157; 362/253

[58] Field of Search ..... 362/23, 26, 27, 28, 362/29, 31, 109, 119, 157, 234, 253, 120

[56] References Cited

U.S. PATENT DOCUMENTS

| | | | |
|---|---|---|---|
| 2,161,872 | 6/1939 | Kostal . | |
| 2,235,109 | 3/1941 | Morey . | |
| 2,395,760 | 5/1944 | Quan . | |
| 2,476,257 | 7/1949 | Haff | 362/23 |
| 3,885,145 | 5/1975 | Wise . | |
| 4,124,879 | 11/1978 | Schoemer | 362/26 |
| 4,432,042 | 2/1984 | Zeller | 362/183 |
| 4,598,340 | 7/1986 | Dwosh et al. | 362/98 |
| 4,700,634 | 10/1987 | Mills et al. | 108/43 |

*Primary Examiner*—Ira S. Lazarus
*Assistant Examiner*—Sue Hagarman
*Attorney, Agent, or Firm*—Hoffmann & Baron

[57] ABSTRACT

An illumination device for use with a hand-held remote control unit comprising a base and a projection extending from the base and the projection is exposed to a space formed by the base and contains an illumination source which is directed toward the space. The space is configured to accommodate receipt of at least a portion of the hand-held remote control unit in the space so as to return the hand-held remote control unit in a position to subject a selected surface thereof to the illumination source for facilitating illumination thereof while permitting actuation and operation of the hand-held remote control unit.

16 Claims, 3 Drawing Sheets

Fig. 1
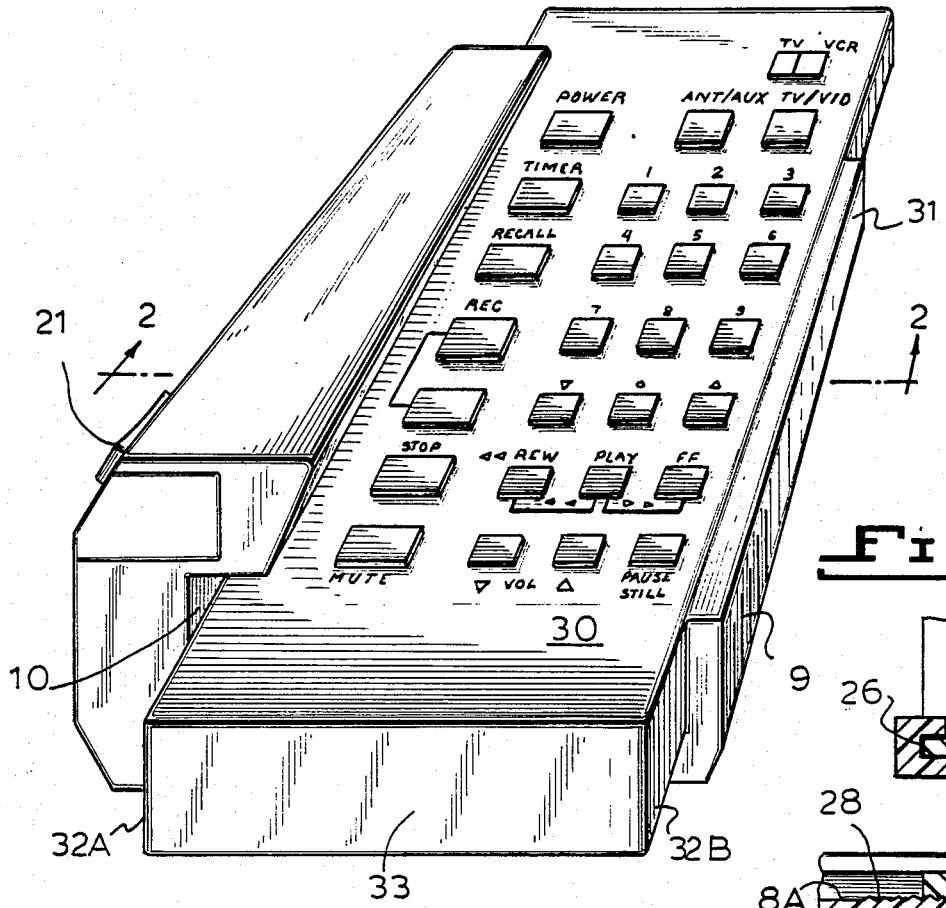
Fig. 1A
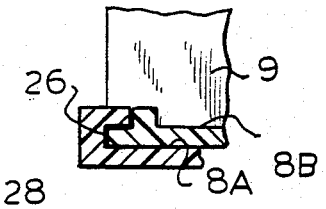
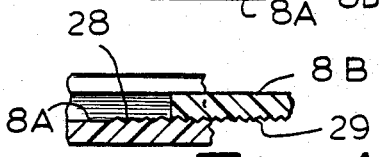
Fig. 1B
Fig. 2
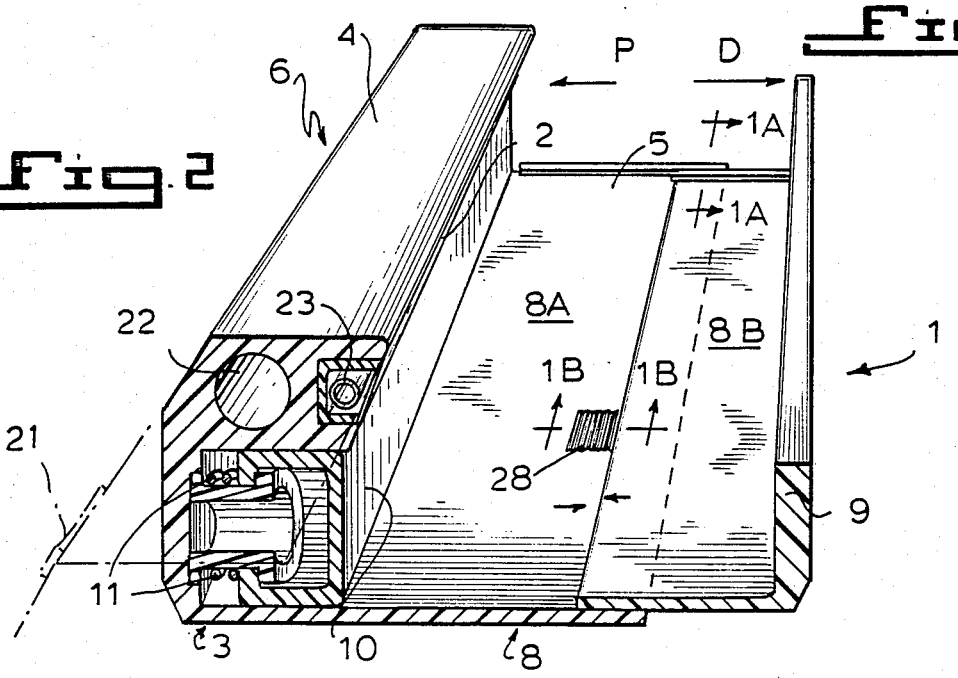

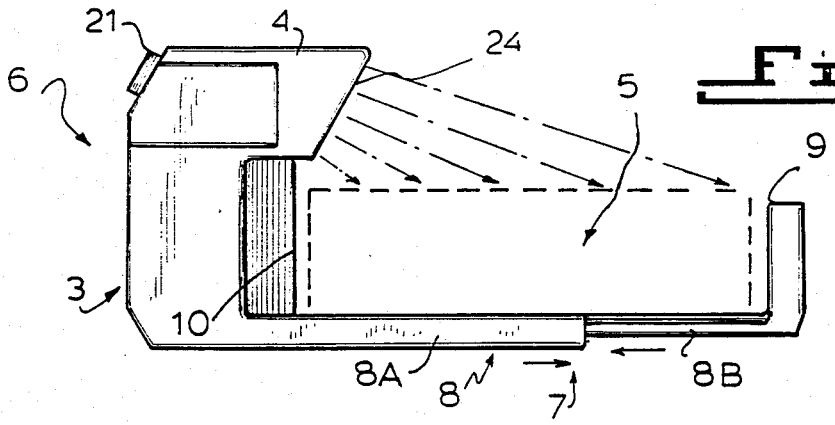
Fig. 3
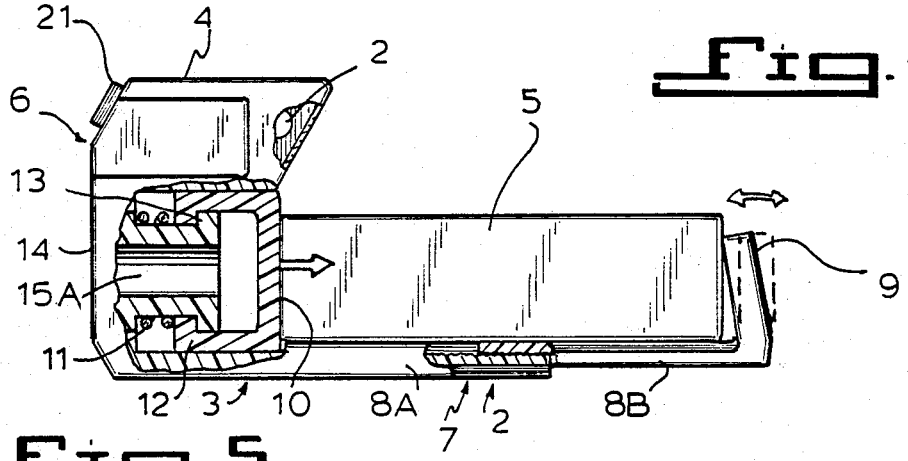
Fig. 4
Fig. 5
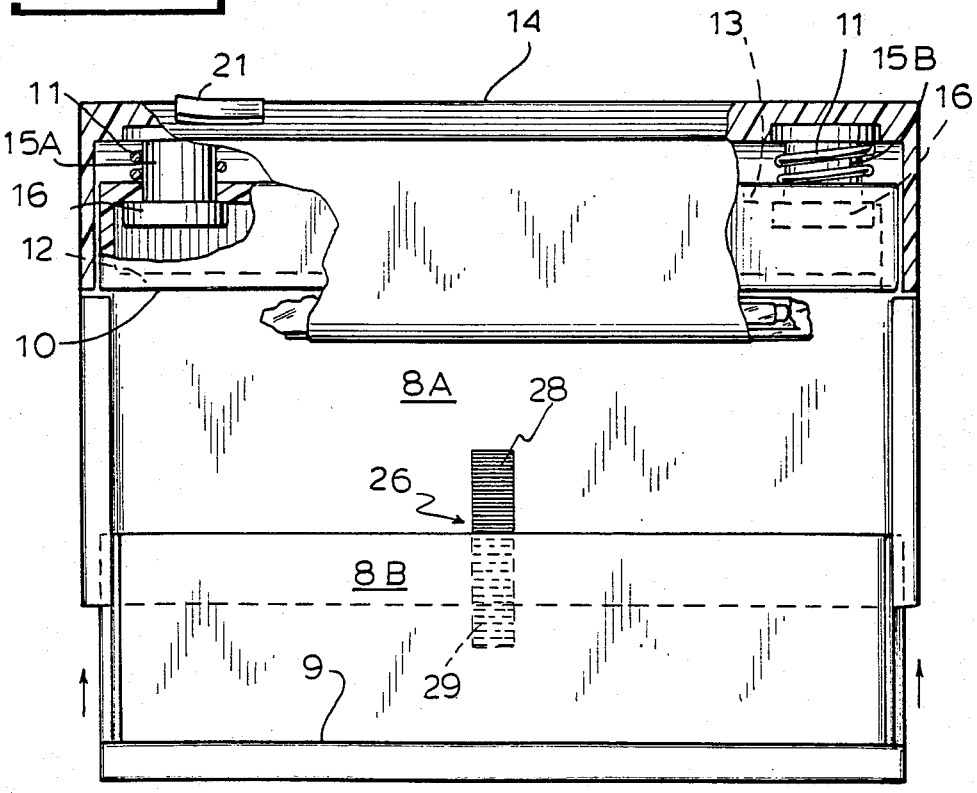

ILLUMINATION DEVICE FOR A HAND-HELD REMOTE CONTROL UNIT

FIELD OF THE INVENTION

The present invention relates generally to illumination devices with hand-held holders therefor, and more particularly to illumination devices for attachment to the casing of a handheld remote control unit used in connection with remotely controlling televisions, video cassette recorders (VCR), compact disc (CD) players and the like, in lowly illuminated environments.

BACKGROUND OF THE INVENTION

When viewing a television broadcast or video-taped movie, using a remote controlled television and/or VCR system, it is most common to operate the hand-held remote control unit in lowly illuminated environments, such as for example, in a darkened room. Such viewing conditions in general, appear to provide improved video images on the TV screen, as well as give the appearance of viewing video-taped movies and the like in a movie theater.

Presently available hand-held remote control units are equipped with numerous programming and selection functions, including video-frame freezing, slow motion, auto-reverse, auto-forward, etc. As a result, it is most common for the front panels of such hand-held remote control units to bear numerous switches, often of membrane type, the number of which typically exceeds ten or more. In addition, each hand-held remote control unit contains a transmitter which usually transmits digitally encoded infra-red light signals from its front side panel to a receiver which is usually contained within the television unit and/or the VCR unit.

While such hand-held remote control units have made television and video-tape viewing much more convenient and thus enjoyable as a result of such remotely controllable programming, recording and playback functions at the user's fingertips, a serious problem nevertheless arises when trying to operate such remote control units in highly desired, lowly illuminated environments. In particular, as a result of the low illumination levels in the viewing room, a television/video viewer with a hand-held remote control unit is incapable of seeing clearly all the programming and selection function switches, that is, without getting out of his or her chair and turning the lights on. This disruption in television viewing is very disturbing and greatly detracts from the viewing experience in general.

In view of this long-felt problem, there presently exist several portable illumination devices which have been designed for attachment to books in particular to facilitate night-time reading while sitting in bed or while sitting as a passenger in a car.

Examples of such prior art illumination devices can be found, for example, in U.S. Pat. Nos. 4,700,634; 4,598,340; 4,432,042; 3,885,145; 2,235,109; 2,161,872; and 2,395,760. However, each device described in these references is wholly unsuitable for facilitating illumination of the front panel of a hand-held remote control unit, while permitting actuation and operation of the hand-held remote control unit without hindrance and/or obstruction.

Accordingly, it is a primary object of the present invention to provide an illumination device for attachment to the casing of a hand-held remote control unit, regardless of its specific dimensions, and to provide a way to illuminate the front panel thereof bearing programming and function selection switches, and therewhile to allow for the unobstructed hand-held operation of the remote control unit.

Another object of the present invention is to provide such an illumination device which has an adjustable mounting means that is capable of adjustment so as to receive and securely hold one of a wide variety of hand-held remote control units having various physical dimensions.

Another object of the present invention is to provide such an illumination device which operates on battery cells, provides a powerful yet diffused beam of illumination on the front panel of the remote control unit, and can be held in one's hand in a manner similar to a hand-held remote control unit itself.

An even further object of the present invention is to provide such an illumination device which is both safe and simple to use, inexpensive to manufacture, and which can be fabricated in large part from light-weight, injection-molded modern plastics.

Other and further objects of the present invention will be explained hereinafter, and will be more particularly delineated in the appended claims, and other objects of the present invention will hereinafter become apparent to one with ordinary skill in the art to which the present invention pertains.

SUMMARY OF THE PRESENT INVENTION

The present invention is an illumination device for attachment to the casing of a hand-held remote control unit having, for example, a front panel bearing a plurality of switches, a rear side panel, a front side panel, and first and second side panels.

In general, the illumination device for use with a hand-held remote control unit comprises a base, a projection extending from the base and an illumination means. The projection is exposed to a space formed by the base, and contains the illumination means which is directed toward the space. The space is configured to accommodate receipt of at least a portion of the hand-held remote control unit in the space, so as to return the hand-held remote control unit in a position to subject a selected surface thereof to the illumination means for facilitating illumination thereof while permitting actuation and operation of the hand-held remote control unit.

In the preferred embodiment, the projection and at least a portion of the base comprise a housing for containment of the illumination means. The housing has a surface permitting the passage of illumination from the illumination means through the surface, and at least a portion of the base comprises a receiving means for receiving the hand-held remote control unit within the space.

In the preferred embodiment, the receiving means includes adjustment means for adjusting the physical dimensions of the receiving space, so as to receive and hold one of a wide variety of hand-held remote control units having various physical dimensions. In particular, the receiving means comprises a substantially planar support base joined to the housing and forms a housing-support-base subassembly having a distal end and a proximal end. The support base has an end side wall which is disposed substantially orthogonal thereto at the distal end, and has a slidable inner end wall which is orthogonally disposed at the proximal end. The slidable inner end wall is biased in the direction towards the end side wall, and preferably a spring means is used to achieve the same. The biased inner side wall provides a desired degree of force exerted on the hand-held remote control unit in the direction towards the end side wall of the receiving means. Thus, the biased inner side wall ensures that the remote control unit will be securely held in the receiving space without risk of falling out upon subjection to normally expected impact forces occasioned during expected use.

In the preferred embodiment, the receiving means includes an adjustment means that is formed by a support base which includes a first planar member joined adjacent to the inner side wall, and a second planar member joined to the end side wall. To provide a variable adjustable receiving space for hand-held remote control units having a variety of physical dimensions, the end side wall of the illumination device is slidably adjustable. In order to achieve this feature of the present invention, one of the first and second planar members is slidably received into the other, and is maintained in a desired relative position by a locking means, which in the preferred embodiment is a pawl and ratchet mechanism arranged between the slidably adjustable first and second planar members. The configuration of the slidable biased inner side wall, the slidably adjustable end side wall, and the support base together form a rectangular receiving space of variable dimensions into which the hand-held remote control unit can be accommodatably received and securely held. In the preferred embodiment, the end side wall is made of a flexible resilient material and is disposed at a small angle slightly less than 90° from the supporting base as to provide a clamping action on and against the adjacent side panel of the hand-held remote control unit accommodatably received within the rectangular space.

The illumination means in general comprises a battery power source, a lamp unit, and an on-off switch, with the battery power source, lamp unit and switch being connected in a series configuration. In the preferred embodiment, the lamp unit comprises three fuse-type incandescent bulbs connected in series configuration, and the battery power source comprises two 1.5 volt pen-light battery cells.

The housing includes a battery compartment for containing the battery power source, and a lamp mounting cavity as well, for mounting the lamp unit therein. The lamp unit is mounted behind the housing surface permitting the passage of illumination therethrough, which is the preferred embodiment, is a light transmissive panel that is made of a translucent material. To effect desired focusing of light, the light transmissive panel is installed over the opening formed by the lamp mounting cavity in the housing. The plane of the glass panel is disposed at an acute angle with respect to the plane of the supporting base as to provide a directed beam of illumination onto the front panel of the hand-held remote control unit received within the rectangular space. To provide improved focusing of light, a focusing reflector can be installed behind the lamp means, within the lamp mounting cavity.

An alternative embodiment of the present invention teaches the use of another form of adjustable receiving means wherein the support base thereof comprises a first planar member joined to the inner side wall and a second planar member joined to the end side wall. In this embodiment, the inner side wall is rendered slidably biased, and one of the first and second planar members is slidably received into the other, and biased for example by a spring means, so that the end side wall is forced to slidably move in the direction towards the inner side wall under the biasing force. With this arrangement, variable adjustment of the physical dimensions is provided between the inner and end side walls, for purposes of securely receiving the hand-held remote control unit inserted into the rectangular space defined therebetween.

As a result of the present invention, a hand-held remote control unit of whatever variety can be equipped with a means for intensely illuminating the front panel thereof bearing programming and function switches, that is, without interfering with the operation of the remote control unit itself, and without substantially altering the overall resulting dimensions thereof as to detract from its otherwise hand-holdable features. Thus, hand-held remote control units so equipped can be simply and conveniently operated in the darkest of viewing environments and without resorting to illuminating the entire video-viewing room as has been conventionally required hitherto.

Moreover, as the illumination device of the present invention conforms in great part to the pre-existing geometry of conventional hand-held remote control units, the illumination device can be turned "on" and "off" with the thumb of the operator, further ensuring that the unit can be simply energized and de-energized upon picking up and setting down, respectively, the hand-held remote control unit accommodatably received within the illumination device of the present invention.

DESCRIPTION OF THE DRAWINGS

For a further understanding of the objects of the present invention, reference is made to the following detailed description of the preferred embodiment which is to be taken in connection with the accompanying drawings, wherein:

FIG. 1 is a perspective view of the illumination device of the present invention, shown attached to the casing of a conventional hand-held remote control unit;

FIG. 1A is a fragmented cross-sectional view of the end of the support base of the illumination device, taken along line 1A—1A of FIG. 2;

FIG. 1B is a fragmented cross-sectional view of the ratchet mechanism of the preferred embodiment, taken along line 1B—1B of FIG. 2;

FIG. 2 is a perspective cross-sectional view of the illumination device of the present invention taken along line 1—1 and showing without the hand-held remote control device;

FIG. 3 is an elevated side view of the preferred embodiment of the illumination device of the present invention;

FIG. 4 is an elevated cross-sectional partially cut-away view of the preferred embodiment of the illumination device of the present invention, showing the spring biased slidable inner side wall and the resiliently flexible biased end side wall with a conventional hand-held remote controlled unit accommodatably received therebetween;

FIG. 5 is a top plan partially cut-away view of the preferred embodiment of the illumination device, showing the slidably biased inner side wall thereof and the adjustment means including a ratchet mechanism;

DETAILED DESCRIPTION OF THE PREFERRED EMBODIMENT

Figure 6:
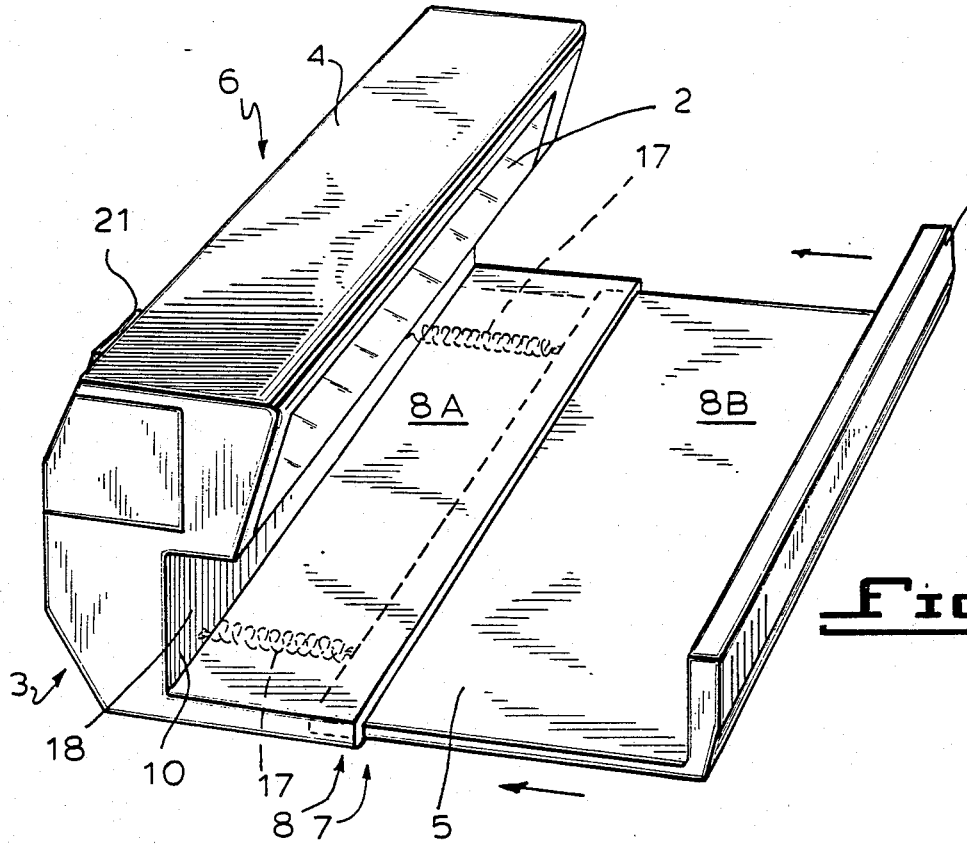
FIG. 6 is a perspective view of an alternative embodiment of the illumination device of the present invention, showing an alternative adjustable mounting means therefor.

Referring to FIGS. 1, 2, 3 and 4 in particular, the illumination device 1 of the present invention is shown generally comprising an illumination means 2, a base 3, and a projection 4 extending from the base 3. A conventional hand-held remote control unit, which is accommodatably received by the illumination device 1, is illustrated in FIG. 1 and typically includes a front panel 30 bearing a plurality of function, selection and programming switches, a front side panel 31 from which infra-red signals are transmitted, a first and second side panel 32A and 32B, respectively, and a rear side panel 33.

As illustrated in FIGS. 1 and 2, in particular, the projection 4 is exposed to a receiving space 5 formed by the base 3 and contains the illumination means 2 which is directed toward the receiving space 5. The space 5 is configured to accommodate receipt of at least a portion of the hand-held remote control unit in the space 5, so as to return the hand-held remote control unit in a position to subject the front panel 30 to the illumination means 2 for facilitating illumination thereof while permitting actuation and operation of the hand-held remote control unit.

In the preferred embodiment, the projection 4 and at least a portion of the base 3 comprises a housing 6 for containment of the illumination means 2, and at least a portion of the base 3 comprises a receiving means 7 for receiving the hand-held remote control unit within the receiving space 5. In general, the receiving means 7 includes a substantially planar support base 8 joined to the housing 6 and forms a housing support base subassembly having distal end indicated by the arrow marked "D" and a proximal end indicated by the arrow marked "P". The support base 8 has a slidably adjustable end side wall 9 which is disposed substantially orthogonal thereto at the distal end. The support base 8 also has a slidable inner end wall 10 which is orthogonally disposed at the proximal end. The slidable inner end wall 10 is biased in the direction towards the end side wall 9, and preferably a spring means 11 is used to achieve the same.

The inner end wall 10 is realized by a rectangular shaped tube 12 having a longitudinally-disposed slot 13 formed along the side wall opposite the inner side wall 10 which abuts against one of the side panels of the hand-held remote control unit. The housing 6 has a lower side portion 14 from which a pair of spring mounting posts 15A and 15B project. Spring means 11 are disposed about each respective spring mounting post 15A and 15B the posts insert through the slot 13 formed in the rectangular shaped tube 12 and each has an end flange 16 to prevent the posts from retracting out from the tube 12. The width of the rectangular shaped tube 12 is selected so that the tube 12 can slide about the flanges 16 under the biasing force of the spring means 11 so that the spacing between the inner side wall 10 and the end side wall 9 can be adjusted by applying sufficient force to overcome the biasing force of the spring mean 11.

The configuration of the slidable, spring-biased inner side wall 10, slidably adjustable end side wall 9, and support base 8 together form the rectangular "receiving" space or channel 5 of variable dimensions, wherein into the hand-held remote control unit can be accommodatably received and securely held. In the preferred embodiment as well, the slidably adjustable end side wall 9 is made of a flexible resilient material, such as rubber, and is disposed at a small angle slightly less than 90° from the supporting base as illustrated in FIG. 4 in particular. This construction provides an advantageous clamping action on and against the adjacent side panel of the hand-held remote control unit as it is accommodatably received within the rectangular space 5.

Referring to FIGS. 2, 4 and 5 in particular, the receiving means 7 is clearly illustrated as well as the means by which the end side wall 9 is slidably adjustable with respect to the biased inner side wall 10, in the preferred embodiment. Therein, the receiving means 7 includes an adjustment means comprising the support base 8 having a first planar member 8A and a second planar member 8B. The first planar member 8A is joined to the inner side wall 10 and/or housing 6, and the second planar member 8B is joined to the end side wall 9 by conventional means known in the art. As illustrated in FIG. 1A, the opposing side edges of the second planar member 8B are slidably received into respective guide channels 26 formed in the first planar member 8A, and the first and second planar members 8A and 8B are maintained in relative adjusted position by a locking means realized in the preferred embodiment by a ratchet mechanism 27.

The ratchet mechanism 27 of the preferred embodiment is illustrated in FIGS. 1B, 4 and 5 in particular, and includes a first ratchet surface 28 and a second ratchet surface 29 disposed on first and second planar members 8A and 8B, respectively. Notably, the ratchet surfaces 28 and 29 are arranged on the first and second planar surfaces 8A and 8B, in order to provide adjustable relative interlocking of the first and second planar members 8A and 8B over a range of positions suitable to accommodate the variety of widthwise dimensions of any particular hand-held remote control unit interposed between the biased inner side wall 10 and the slidably adjustable end side wall 9.

Specifically, the first ratchet surface 28 comprises a plurality of teeth, and is centrally located on the top surface of the first planar member 8A, and runs from the edge thereof toward the proximal end of the illumination device, as shown in FIG. 5. The second ratchet surface 29 also comprises a plurality of teeth which are centrally located on the edge of the bottom surface of the second planar member 8B. Notably, the mating teeth of the first and second ratchet surfaces 28 and 29 are configured so that the second planar member 8B can be easily slid towards the inner side wall 10 with an incremental locking action achieved by the relative sliding movement between the engaging surfaces of the mating teeth. This incremental locking action facilitates incremental adjustment of the widthwise dimensions of the receiving channel 5, as the end side wall is pushed towards the inner side wall 10. With the ratchet mechanism 27 of the preferred embodiment, the second planar member 8B is prevented from sliding out from the first planar member away from the proximal end of the illumination device, since the mating teeth prevent such movement. However, in order to release the ratchet mechanism 27 from its locked position, all that is required is to lift up on the outer end of the second planar member 8B, near the end side wall 9. As a result of (a) proper tolerances provided between (i) respective guide channels 26 of the first planar member 8A and (ii) the side edges of the second planar member 8B slidably received therewithin and (b) resilient deflection across the second planar member 8B, there is sufficient clearance for the teeth of the second ratchet surface 29 to lift out of and clear above the first ratchet surface 28 while the distal end of the second planar member 8B is lifted upwardly, so that the second planar member 8B and attached side end wall 9 can be slidably moved away from the inner side wall 10, thereby expanding the widthwise dimensions of the receiving space 5.

Referring to FIG. 6, there is shown an alternative embodiment of the illumination device 1 of the present invention. Therein, the receiving means 7 includes an adjustment means comprising support base 8 having a first planar member 8A and a second planar member 8B joined in a manner described hereinabove. In this alternative embodiment, however, besides being slidably received into one another, one of the first and second planar members 8A and 8B is biased, for example, by spring means 17, so that the end side wall 9 is forced to slidably move in the direction towards the inner side wall 10 under a spring-loaded biasing force. In addition, the biasing means on the inner side wall 10 can be eliminated from this embodiment, to provide a slight longitudinal recess 18 below the projection 3 of the housing 4, under which the edge portion of the hand-held remote control unit can be received.

Figure 7:
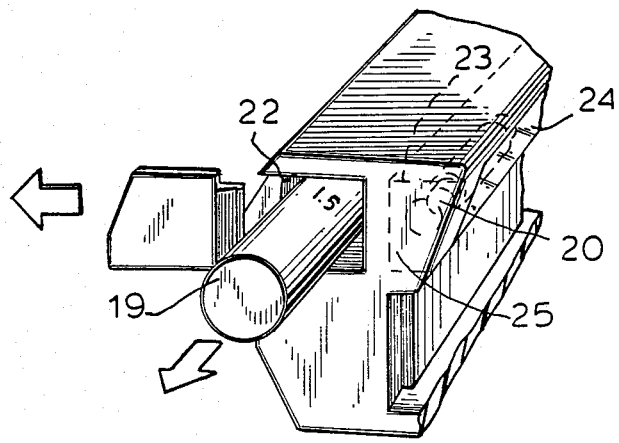
FIG. 7 is a perspective end side view of the housing showing the opening of the battery storage compartment with a battery cell being slidably removed therefrom with the battery compartment door in the open position.
Figure 8:
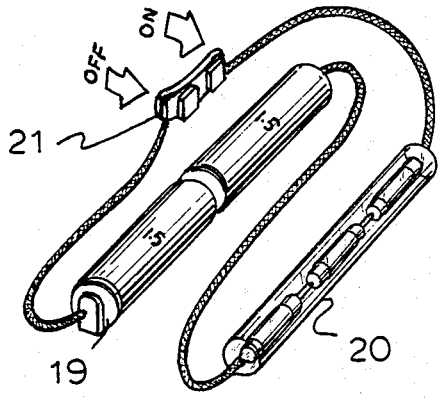
FIG. 8 is a schematic diagram of the illumination means showing an on-off switch, two 1.5 V cells and three fuse-type incandescent lamps, all being connected together in a series configuration.

Referring to FIGS. 2, 7 and 8, the illumination means of the preferred embodiment of the illumination device hereof, will now be described. In general, the illumination means comprises a battery power source 19, a lamp unit 20, and an on-off switch 21, with the battery power source 19, lamp unit 20 and switch 21 being connected in a series configuration. The lamp unit 20 comprises three fuse-type incandescent bulbs connected in series configuration, and the battery power source 19 comprises two 1.5 volt pen-light (e.g. AA type) battery cells connected in series. The bulbs, while having a long operation life, can be replaced, and the batteries can be of the disposable or rechargeable type. The switch 21 is mounted on the upper end of the outer side wall 14 of the housing 6 in a position which is aligned with the operator's thumb when the illumination device 1 is held in his or her hand as would be the remote control unit, as well.

Referring to FIG. 7, the end of the housing 6 is shown. As illustrated, the housing includes a battery compartment 22 for containing the battery cells 19, and a lamp mounting cavity 23 as well, for mounting the lamp unit 20 therein. The lamp unit 20 is mounted behind a housing surface 24 permitting the passage of radiant illumination therethrough. In the preferred embodiment, the light-transmissive housing surface 24 is a light-transmissive panel that is made of a translucent material, such as glass or plastic, which snaps into an appropriately formed groove formed in the outer defining perimeter of the lamp mounting cavity 23 A longitudinally concave or parabolic reflector 25 is mounted in the lamp mounting cavity 23, behind the lamp unit 20, and serves to focus or otherwise concentrate radiant illumination in a direction perpendicular to the plane of the light-transmissive panel 24. In order to replace any one or more of the fuse-type incandescent bulbs 20, the light transmissive panel 24 is simply pried off from the front of the lamp mounting cavity 23, the old bulb removed from its mounting socket, and a new bulb inserted therewithin.

To effect efficient illumination of the front panel of the hand-held remote control unit, the plane of the glass panel 24 is disposed at an acute angle with respect to the plane of the supporting base 8, as illustrated in FIG. 3. This is further achieved by the projection 4 of the housing 6 (containing the lamp mounting cavity 23), being slightly canted or tipped in the direction towards the front panel 30 of the remote control unit, as illustrated in FIGS. 3 and 4 in particular. With such a housing configuration, a beam of intensely focused illumination can be simply and effectively directed onto the front panel 30 of the remote control unit that is accommodatably received in the variable rectangular space 5 of the illumination device 1.

It is contemplated that modification to the illumination device 1 hereof would involve making the projection 4 (containing the illumination means 2), adjustable with respect to the base 3. This could involve joining the projection 4 to the base 3 by a hinge means, thereby providing variable angular adjustment of the beam of illumination with respect to portions of a remote control unit to be illuminated.

While the particular embodiments shown and described above have been proven to be useful in many applications involving the hand-held remote control arts, further modifications of the present invention herein disclosed will occur to persons skilled in the art to which the present invention pertains and all such modifications are deemed to be within the scope and spirit of the present invention defined by the appended claims.

What is claimed is:

1. An illumination device for use with a hand-held remote control unit having a length, width and height and a front control panel, said illumination device comprising:

a base and a projection extending from and projecting above said base and being exposed to a space formed by said base;

said projection containing illumination means directed toward said space, said illumination means being capable of producing light rays;

said space being configured to accommodate receipt of at least a portion of the length of said hand held remote control unit and the entire width and height thereof in said space so as to return the hand-held control unit in a position to subject a selected surface of said front control panel to said illumination means for facilitating illumination of said selected surface by reflecting light rays therefrom, while permitting actuation and operation of the hand-held remote control unit.

2. The illumination device of claim 1, wherein said illumination means comprises a battery power source, a lamp unit, and an off-on switch, said battery power source, lamp unit and switch being connected in a series configuration.

3. The illumination device of claim 1, wherein said projection and at least a portion of said base comprises a housing for containment of said illumination means, said housing having a surface permitting the passage of illumination from said illumination means therethrough, and wherein at least a portion of said base comprises a receiving means for receiving the hand-held remote control unit in said space.

4. The illumination device of claim 3, wherein said receiving means comprises a substantially planar support base joined to said housing and forming a housing-support base subassembly having a distal end and a proximal end, said support base further having an end side wall orthogonally disposed at said distal end, and an inner end wall orthogonally disposed at said proximal end, said inner wall, end side wall and support base forming said space of rectangular dimensions and into which the hand-held remote control unit can be accommodatably received and securely held.

5. The illumination device of claim 3, wherein said illumination means comprises a battery power source, a lamp unit, and an on-off switch, said battery power source, lamp unit and switch being connected in a series configuration.

6. The illumination device of claim 5, wherein said housing includes a battery compartment for containing said battery power source, and a lamp mounting cavity for mounting said lamp unit therein, said lamp unit being mounted behind said surface permitting the passage of said illumination therethrough.

7. An illumination device for use with a hand-held remote control unit comprising:

a base and a projection extending from said base and being exposed to a space formed by said base;

said projection containing illumination means directed toward said space;

said projection and at least a portion of said base comprising a housing for containment of said illumination means, said housing having a surface permitting the passage of illumination from said illumination means therethrough, and wherein at least a portion of said base comprises a receiving means for receiving the hand-held remote control unit in said space, said receiving means including an adjustment means for adjusting the physical dimensions of said space, so as to receive and hold one of a wide variety of hand-held remote control units having various physical dimensions, said space being configured to accommodate receipt of at least a portion of the hand-held remote control unit in said space so as to return the hand-held control unit in a position to subject a selected surface thereof to said illumination means for facilitating illumination thereof while permitting actuation and operation of the hand-held remote control unit.

8. An illumination device for use with a hand-held remote control unit comprising:

a base and a projection extending from said base and being exposed to a space formed by said base;

said projection containing illumination means directed toward said space, said projection and at least a portion of said base comprising a housing for containment of said illumination means, said housing having a surface permitting the passage of illumination from said illumination means therethrough, and wherein at least a portion of said base comprises a receiving means for receiving the hand-held remote control unit in said space, said receiving means including a substantially planar support base joined to said housing and forming a housing-support subassembly having a distal end and a proximal end, said support base further having an end side wall disposed substantially orthogonally at said distal end, and a slidable inner end wall orthogonally disposed at said proximal end and being biased in the direction towards said end side wall, said slidable biased inner wall, end side wall and support base forming said space of variable rectangular dimensions into which the hand-held remote control unit can be accommodatably received and securely held, said space being configured to accommodate receipt of at least a portion of the hand-held remote control unit in said space so as to return the hand-held control unit in a position to subject a selected surface thereof to said illumination means for facilitating illumination thereof while permitting actuation and operation of the hand-held remote control unit.

9. The illumination device of claim 8, wherein said end side wall is made of a flexible resilient material and is disposed at a small angle less than 90° from said supporting base as to provide a clamping action on and against the adjacent side panel of the hand-held remote control unit accommodatably received within said rectangular space.

10. An illumination device for use with a hand-held remote control unit comprising:

a base and a projection extending from said base and being exposed to a space formed by said base;

said projection containing illumination means directed toward said space;

said projection and at least a portion of said base comprising a housing for containment of said illumination means, said housing having a surface permitting the passage of illumination from said illumination means therethrough, and wherein at least a portion of said base comprises a receiving means for receiving the hand-held remote control unit in said space, said receiving means including a substantially planar support base joined to said housing and forming a housing-support base subassembly having a distal end and a proximal end, said support base further having an end side wall orthogonally disposed at said distal end, and an inner end wall orthogonally disposed at said proximal end, said inner wall, end side wall and support base forming said space of rectangular dimensions and into which the hand-held remote control unit can be accommodatably received and securely held, adjustment means formed by said support base having a first planar member joined to said inner side wall, and a second planar member joined to said end side wall, one of said first and second planar members slidably being received into the other, thereby providing for variable adjustment of the physical dimensions between said inner and end side walls and securely receiving the hand-held remote control unit inserted into said space, said space being configured to accommodate receipt of at least a portion of the hand-held remote control unit in said space so as to return the hand-held control unit in a position to subject a selected surface thereof to said illumination means for facilitating illumination thereof while permitting actuation and operation of the hand-held remote control unit.

11. The illumination device of claim 10, wherein said adjustment means further includes a ratchet and pawl mechanism including a ratchet and a pawl being disposed on first and second planar members as to provide an adjustable relative interlocking of said first and second planar members.

12. The illumination device of claim 10, wherein said adjustment mechanism further includes at least one biasing means connected to said first and second planar members so that said end side wall is forced to slidably move in the direction towards said inner side wall under a biasing force.

13. The illumination device of claim 12, wherein said biasing means comprises a spring means connected to said first and second planar members so that said end side wall is forced to slidably move in the direction towards said inner side wall under a spring-loaded biasing force.

14. An illumination device for use with a hand-held remote control unit comprising:

a base and a projection extending from said base and being exposed to a space formed by said base;

said projection containing illumination means directed toward said space;

said projection and at least a portion of said base comprising a housing for containment of said illumination means, said housing having a surface providing a passage for illumination from said illumination means to pass through said passage, and wherein at least a portion of said base comprises a receiving means for receiving the hand-held remote control unit in said space, said illumination means including a battery power source, a lamp unit, and an on-off switch, said battery power source, lamp unit and switch being connected in a series configuration, said housing including a battery compartment for containing said battery power source, and a lamp mounting cavity for mounting said lamp unit therein, said lamp unit being mounted behind said surface and permitting said illumination to pass through said passage, said passage including a light transmissive panel installed over the opening formed by said lamp mounting cavity in said housing, the plane of said glass panel being disposed at an acute angle with respect to the plane of said supporting base as to provide a directed beam of illumination onto the front panel of the hand-held remote control unit received within said space, said space being configured to accommodate receipt of at least a portion of the hand-held remote control unit in said space so as to return the hand-held control unit in a position to subject a selected surface thereof to said illumination means for facilitating illumination thereof while permitting actuation and operation of the hand-held remote control unit.

15. The illumination device of claim 14, wherein said light transmissive panel is made of translucent material.

16. The illumination device of claim 15, wherein said lamp unit comprises three fuse-type incandescent bulbs connected in series configuration, and said battery power source comprises two 1.5 volt penlight battery cells.

* * * * *